US008662828B2

(12) United States Patent
Gendraud et al.

(10) Patent No.: US 8,662,828 B2
(45) Date of Patent: Mar. 4, 2014

(54) HIGH PRESSURE TURBINE OF A TURBOMACHINE WITH IMPROVED ASSEMBLY OF THE MOBILE BLADE RADIAL CLEARANCE CONTROL BOX

(75) Inventors: Alain Dominique Gendraud, Vernou la Celle sur Seine (FR); Delphine Roussin-Leroux, Samois sur Seine (FR); Jean-Luc Le Strat, Saint Michel sur Orge (FR); Pascal Tatiossian, Paris (FR)

(73) Assignee: SNECMA, Paris (FR)

( * ) Notice: Subject to any disclaimer, the term of this patent is extended or adjusted under 35 U.S.C. 154(b) by 554 days.

(21) Appl. No.: 12/994,969

(22) PCT Filed: May 25, 2009

(86) PCT No.: PCT/EP2009/056279

§ 371 (c)(1),
(2), (4) Date: Nov. 29, 2010

(87) PCT Pub. No.: WO2009/144191

PCT Pub. Date: Dec. 3, 2009

(65) Prior Publication Data

US 2011/0076135 A1 Mar. 31, 2011

(30) Foreign Application Priority Data

May 28, 2008 (FR) ..... 08 53471

(51) Int. Cl.
*F01D 11/24* (2006.01)
*F01D 25/04* (2006.01)

(52) U.S. Cl.
USPC ..... 415/119

(58) Field of Classification Search
USPC ..... 415/119
See application file for complete search history.

(56) References Cited

U.S. PATENT DOCUMENTS 3,759,038 A * 9/1973 Scalzo et al. ..... 60/800
5,772,400 A 6/1998 Pellow (Continued)

FOREIGN PATENT DOCUMENTS

DE 22 58 719 6/1973
EP 0 892 153 A1 1/1999

(Continued)

OTHER PUBLICATIONS

International Search Report issued May 28, 2008 in PCT/EP2009/056279 filed May 25, 2009 (with English translation of category of cited documents).

(Continued)

*Primary Examiner* — Nathaniel Wiehe
*Assistant Examiner* — Brian O Peters
(74) *Attorney, Agent, or Firm* — Oblon, Spivak, McClelland, Maier & Neustadt, L.L.P.

(57) ABSTRACT

A high pressure turbine of a turbomachine such as a turbojet, in which a control box of radial clearances of rotating blades are provided. An annular element including a determined flexibility has one end fixed to an annular support and the other end supported by a simple axial bearing with a given pressure on the upstream side of the control box. Thus, disturbing vibration loads are prevented at the attachment points of the control box with the external casing of turbines, thereby also eliminating the risk of cracks occurring.

10 Claims, 4 Drawing Sheets

(56) References Cited

U.S. PATENT DOCUMENTS

| | | | | |
|---|---|---|---|---|
| 6,035,929 | A | 3/2000 | Friedel et al. | |
| 6,726,446 | B2 | 4/2004 | Arilla et al. | |
| 7,114,914 | B2 | 10/2006 | Gendraud et al. | |
| 7,287,955 | B2 | 10/2007 | Amiot et al. | |
| 7,367,776 | B2 | 5/2008 | Albers et al. | |
| 2004/0251639 | A1 * | 12/2004 | Parker | 277/630 |
| 2005/0042080 | A1 | 2/2005 | Gendraud et al. | |
| 2007/0012043 | A1 * | 1/2007 | Parker et al. | 60/752 |
| 2009/0104026 | A1 | 4/2009 | Dakowski et al. | |

FOREIGN PATENT DOCUMENTS

| | | | |
|---|---|---|---|
| EP | 1 505 261 | A1 | 2/2005 |
| JP | 5-214962 | A | 8/1993 |
| JP | 2004-3492 | A | 1/2004 |

OTHER PUBLICATIONS

Search Report issued Jan. 16, 2009 in French Patent Application No. FR 709182 (with English translation of category of cited documents).

Combined Chinese Office Action and Search Report issued Apr. 9, 2013 in Patent Application No. 200980119048.1 (with English language translation).

* cited by examiner

HIGH PRESSURE TURBINE OF A TURBOMACHINE WITH IMPROVED ASSEMBLY OF THE MOBILE BLADE RADIAL CLEARANCE CONTROL BOX

TECHNICAL DOMAIN AND PRIOR ART

This invention relates to a high pressure turbine in a turbomachine such as an aircraft turbojet or turboprop.

A high pressure turbine in a turbomachine comprises at least one stage containing a distributor formed from an annular row of fixed guide vanes and a bladed wheel mounted free to rotate on the downstream side of the distributor in a cylindrical or tapered and truncated cone shaped assembly of ring sectors placed circumferentially end to end. These ring sectors comprise means of attachment to an annular support at their forward and aft ends, and the annular support is fixed to a turbine external casing.

The radial clearances between the mobile blades of the wheel and the ring sectors must be minimised to improve the turbomachine efficiency while avoiding friction between the ends of the blades on the ring sectors, which would cause wear at these ends and reduce the efficiency of the turbomachine under all running conditions.

The use of implanted annular crowns surrounding the fixed ring through which air is drawn off from other parts of the turbomachine so as to minimise radial clearances has already been disclosed. The drawn off air is thus injected on the external surface of the fixed ring and causes thermal expansions or contractions of the fixed ring, thus varying its diameter. Thermal expansions and contractions are controlled by a valve depending on the operating speed of the turbine, and the valve can be controlled to control the flow and temperature of air entering the ducts. The assembly composed of the ducts and the valve is usually called the blade tip clearance control box.

The applicant has thus submitted a patent application FR 2 865 237 disclosing a particularly high performance control box since injected air enables efficient and homogeneous cooling.

FIGS. 1 and 1A show one example assembly of the control box on the external casing of the turbomachine high pressure turbine. These figures show a wall 400 of the control box 40 fixed to the external casing 22 of the turbine 10 at two diametrically opposite points through a threaded ring 4.

The inventors observed that during operation of the turbomachine equipped with the high pressure turbine, vibrations occur in the control box that can cause damage to its attachment points. There is a risk of cracks occurring at its attachment points.

The purpose of the invention is to disclose a solution to prevent disturbing loads at the attachment points of the control box to the external casing during operation of the high pressure turbine of a turbomachine.

PRESENTATION OF THE INVENTION

To achieve this, the purpose of the invention is a high pressure turbine for a turbomachine comprising:

- an external casing,
- at least one distributor formed from an annular row of fixed guide vanes,
- a bladed wheel installed free to rotate on the downstream side of the distributor,
- an assembly forming a ring placed at the circumference of the rotating blades,

- a device to control the radial clearance between the tips of the rotating blades and the ring comprising a control box supporting drilled annular headers and fixed to the external casing at at least two points at a distance from each other,
- an annular support supporting the ring and fixed to the external casing, characterised in that it also comprises an annular element with a predetermined flexibility with one end fixed to the annular support and the other end supported by a simple axial bearing with a given pressure on the upstream side of the control box, the annular element with a predetermined flexibility and bearing at a given pressure thus forming a shock absorber for at least some of the vibrations of the box generated during operation of the turbomachine.

One advantageous example of the control box that can be used in the invention is disclosed in the embodiment described in patent application FR 2 865 237. Therefore the entire content of this prior application is included within this application.

According to the invention, the energy of the vibrations of the box generated by excitation modes of the turbomachine is dissipated by a combination of friction at the axial bearing and braking of the control box due to bending of the additional annular element.

This avoids the risk of cracks appearing at the attachment points making some vibrational loads no longer critical.

In other words, the shock absorbing element according to the invention disturbs the development of harmful vibration modes.

Consequently, the life of the control box is improved.

According to one embodiment, the annular shock absorbing element is a metal section made by machining or forming a metal plate.

Advantageously, the geometric shape of the annular shock absorbing element is composed of a continuous crown fixed to the annular support and extended by a plurality of identical, equally spaced blades at an inclination from the crown, the curved end of which forms the pressure bearing with the upstream side of the box.

Preferably, the number of blades in the annular shock absorbing element will be equal to a multiple of eighteen. Studies have shown that this choice, for example using seventy-two blades uniformly distributed around the circumference for a 0.680 m diameter have been perfectly satisfactory.

According to one advantageous variant embodiment, the control box and the annular shock absorbing element are made from the same material.

According to another variant, anti-wear material is inserted in the bearing area between the shock absorbing element and the upstream side of the box so reduce wear of the shock absorber or the box due to friction. A layer of anti-wear material is preferably deposited on the upstream side of the box in the bearing area with the shock absorbing element.

According to one variant embodiment, the annular shock absorbing element is composed of at least two angular sectors fixed end to end forming the complete annular shape of the shock absorber. Thus, the shock absorbing element is preferably composed of two, six or eighteen angular sectors fixed end to end forming the complete annular shape of the shock absorber.

Preferably, the annular shock absorbing element is fixed to the annular support through screws that also attach the axial spacer stops. These parts are usually called stop plates.

The metal section may comprise at least one angular sector of a continuous crown prolonged by a plurality of identical blades, uniformly spaced and inclined relative to the crown sector and the end of which is curved.

Finally, the invention also relates to a turbomachine comprising a high pressure turbine like that described above.

BRIEF DESCRIPTION OF THE DRAWINGS

Other advantages and characteristics of the invention will become clearer after reading the detailed description given as an example with reference to the following figures, among which.

DETAILED PRESENTATION OF PARTICULAR EMBODIMENTS

Figure 1:
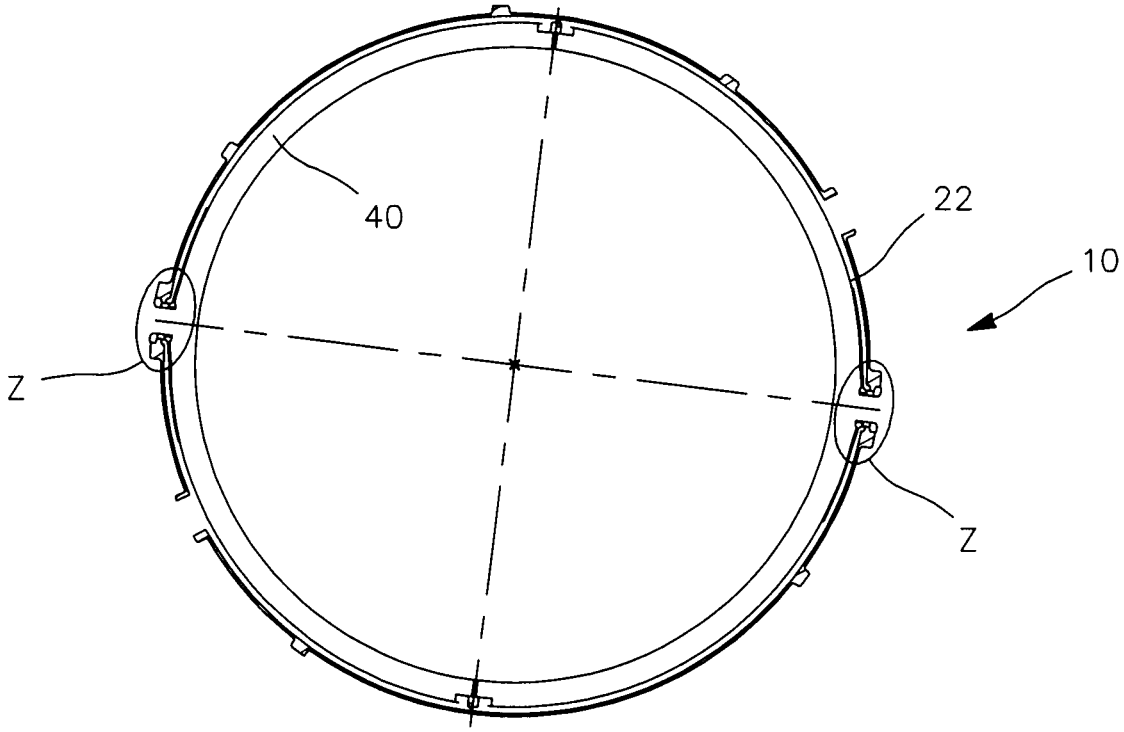
FIG. 1 is a diagrammatic cross-sectional view of a turbojet high pressure turbine at the attachment points of the control box to the external casing.

FIG. 1 diagrammatically shows part of a turbomachine such as an aircraft turbojet or turboprop comprising a high pressure turbine 10 arranged on the downstream side of a combustion chamber 12 and the upstream side of a low pressure turbine 14 of the turbomachine.

The combustion chamber 12 comprises an external wall of revolution 50 connected at its downstream end to a radially internal end of a tapered and truncated wall 58 that comprises a radially external annular flange 60 at its radially external end used to attach it to a corresponding annular flange 62 on an external casing 64 of the chamber.

The high pressure turbine 10 comprises a single turbine stage in which there is a distributor 16 formed of an annular row of fixed guide vanes, and a bladed wheel 18 fitted free to rotate on the downstream side of the distributor 16.

The low pressure turbine 14 comprises several turbine stages, each of these stages also comprising a distributor and a bladed wheel, only the distributor 47 of the upstream low pressure stage being visible in FIG. 1.

The bladed wheel 18 of the high pressure turbine rotates inside an approximately cylindrical assembly of ring sectors 20 placed circumferentially end to end and suspended from an external casing 22 of the turbine through an annular support 24. This annular support 24 comprises means 26 of attaching the ring sectors 20 at its internal periphery, and comprises a wall 28 that extends outwards and in the upstream direction and that is connected to a radially external flange 30 for attachment of the external casing 22 of the turbine at its radially external end. The flange 60 is axially inserted between the flange 30 and the flange 62 of the external casing 22 of the turbine and is axially clamped between these flanges by appropriate screw-nut type means 7.

The annular support 24 comprises two upstream and downstream radial annular walls 34, 36 respectively at its internal periphery, that are connected to each other through a cylindrical wall 38. The radial walls 34, 36 comprise cylindrical rims 340, 360 facing downstream at their radially internal ends, and these rims 340, 360 cooperate with circumferential hooks 201, 202 fitted at the downstream and upstream ends of the ring sectors 20. An annular locking device 46 with a C-shaped section is axially engaged at the downstream end on the downstream cylindrical rim 360 of the support and on the downstream hooks 201 of the ring sectors 20 to lock the assembly.

The wall 28 of the annular support 24 and the tapered and truncated wall 58 of the chamber define an annular containment 80 supplied with ventilation and cooling air through orifices 82 formed in the tapered and truncated wall 58. Orifices not shown are formed in the upstream radial wall 34 of the annular support 24 to create fluid communication between the containment 80 and an annular cavity 86 to cool ring sectors 20 delimited on the outside by the cylindrical wall 28 of the annular support.

The external wall 66 of the distributor comprises an annular groove 74 at each of its upstream and downstream ends, opening up in the radial direction to the exterior. Annular sealing packing 76 is housed in these grooves 74 and cooperates with cylindrical ribs 78 formed on the tapered and truncated wall 58 and on the upstream radial wall 34 of the annular support 24 respectively, to prevent gas from passing radially outwards from the turbine flowstream through the external wall 66, and conversely to prevent air from passing radially inwards from the containment 80 into the turbine flowstream.

The radial clearance between the tips of the mobile blades of the bladed wheel 18 and the ring 20 also has to be minimised to increase the efficiency of the turbine.

Therefore, an additional device D is provided to control the clearance. This device D comprises a circular control box 40 surrounding the fixed ring 20, and more precisely the annular support 24.

Depending on the turbomachine running speed, the control box 40 is designed either to cool or heat the upstream rib 240 and the downstream rib 242 of the annular support 24 by blowing air on these blades. The annular support 24 contracts or expands as this air comes into contact with it, which reduces or increases the diameter of the fixed ring segments 20 of the turbine so as to vary the clearance at the blade tips of the bladed wheel 18.

The control box 40 supports at least three annular air circulation headers 41, 42 and 43 that surround the annular support 24 of the fixed ring assembly. These headers are at an axial spacing from each other and are approximately parallel to each other. They are arranged on each side of the side faces of each of the ribs 240, 242 and they approximately match the shape of these ribs.

The control box 40 also comprises an air collection tube not shown to supply air to the air circulation headers 41, 42 and 43. This air collection tube surrounds the headers 41, 42 and 43 and supplies air to them through air ducts 44.

In the embodiment illustrated, such a control box 40 is composed of two half-shells clamped together and is fixed to the external casing 22 through threaded rings 45 at two diametrically opposite points (FIG. 1).

The inventors have observed that during operation of the turbomachine comprising the high pressure turbine 10 as illustrated above, there can be a risk of cracks appearing at the attachment points 45. They have demonstrated that this is due to the fact that the control box 40 is subjected to harmful vibrations that can cause damage at its attachment points 45.

Figure 1A:
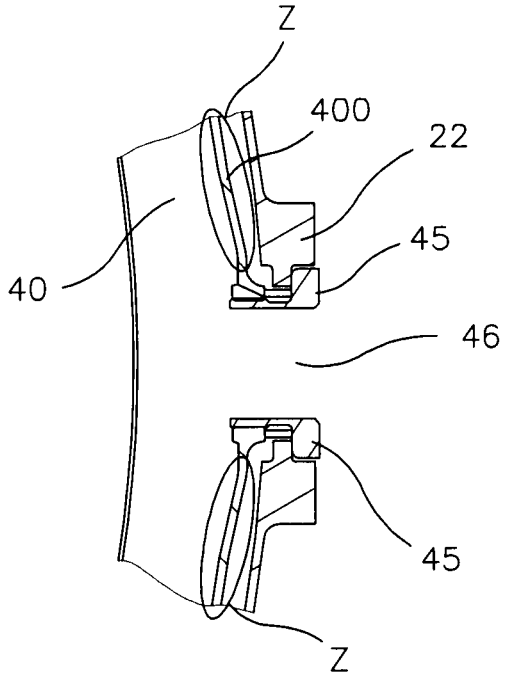
FIG. 1A is a detailed view of FIG. 1 showing an attachment zone of the control box attached to the external casing.

FIGS. 1 and 1A diagrammatically show elliptical contours representing the precise zones Z in which there is a risk of cracks appearing in the vicinity of the attachment holes 46.

Figure 2:
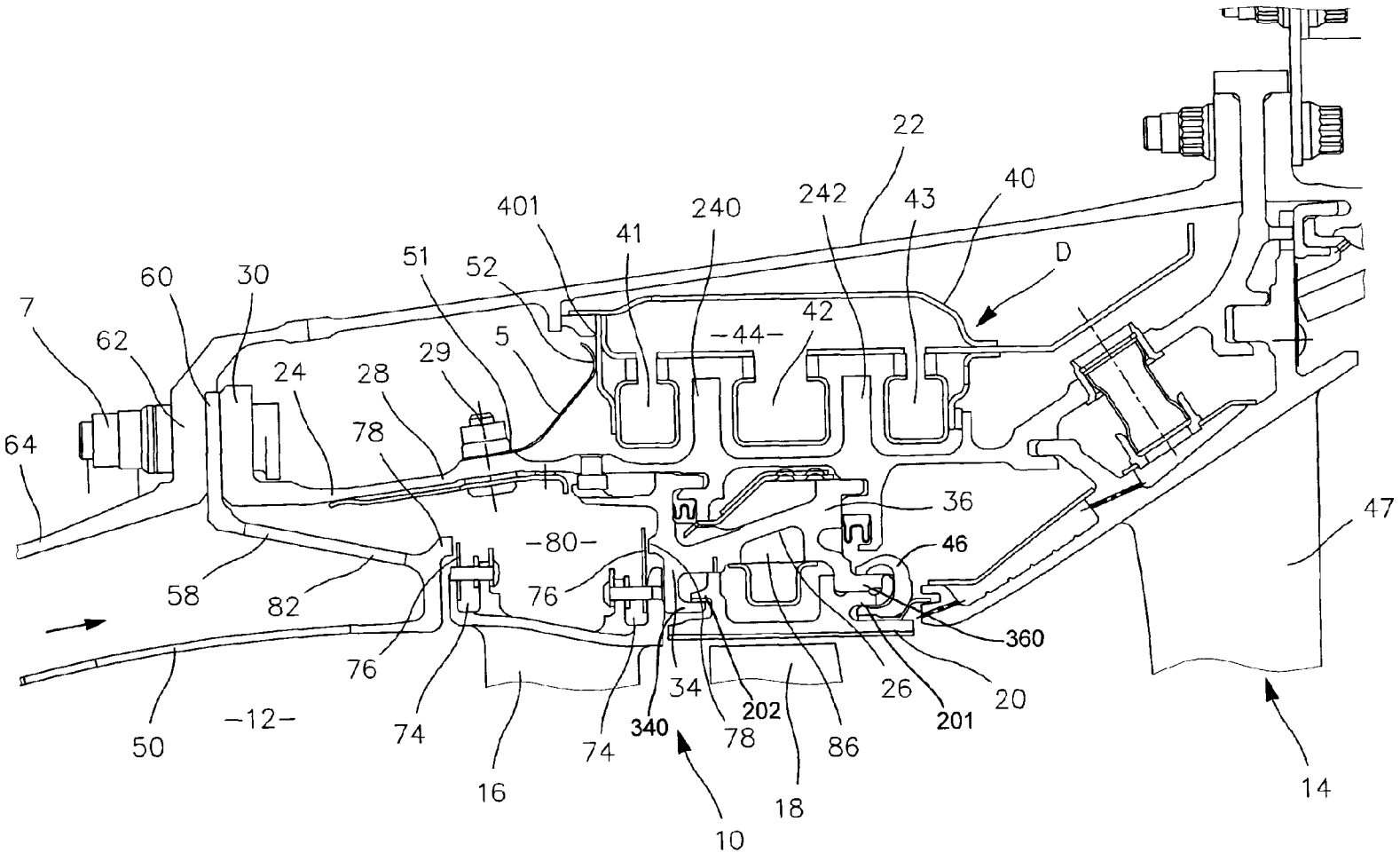
FIG. 2 is a partial diagrammatic half longitudinal sectional view of a turbojet high pressure turbine according to the invention.
Figure 4:
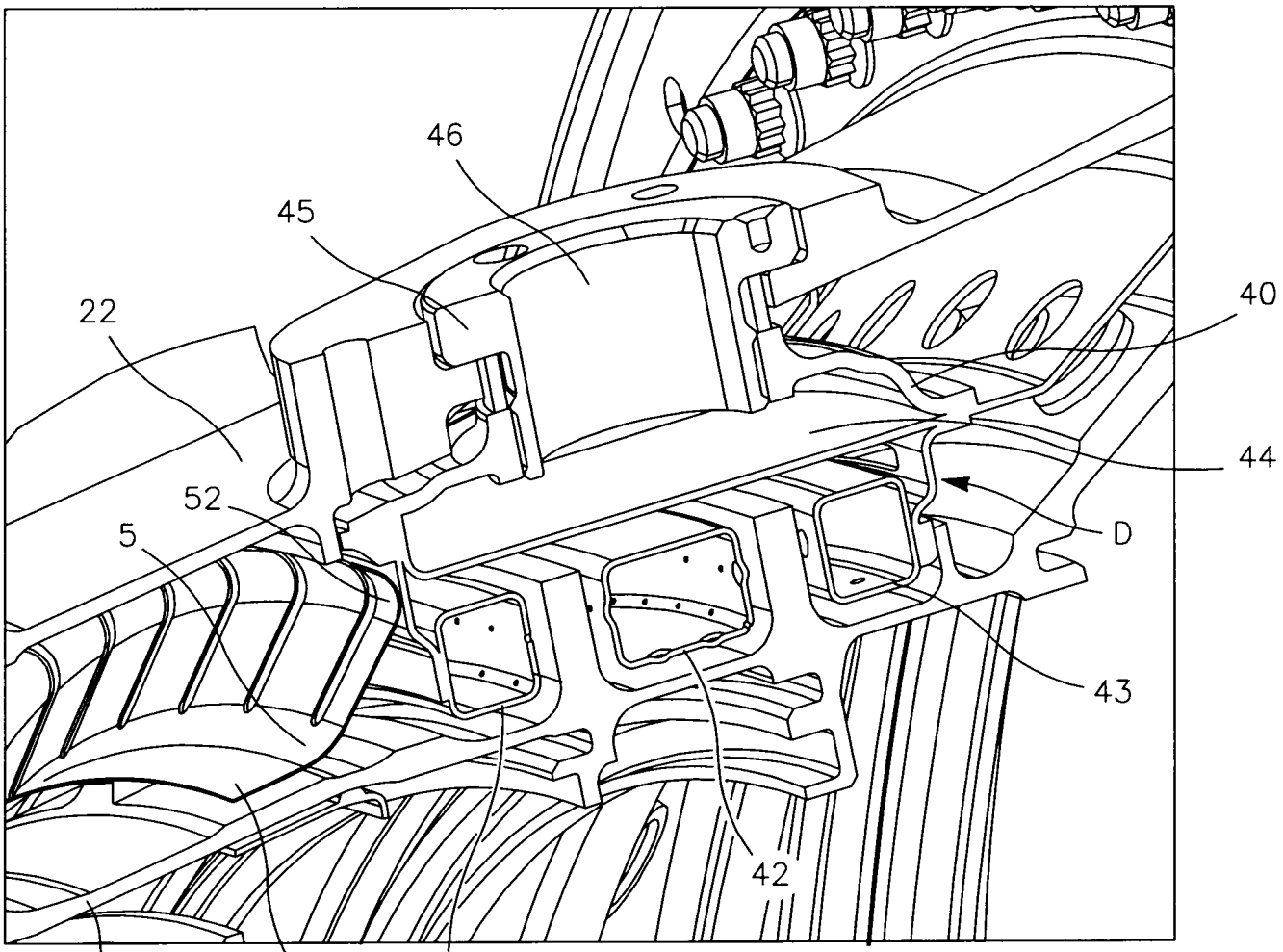
FIG. 4 is a partial perspective sectional view of a high pressure turbine according to the invention made at the attachment points of the control box to the external casing.

The invention mitigates this risk of cracks by implanting an annular element 5 with a predetermined flexibility inside the cavity delimited by the annular support 24 and the external casing 22 upstream from the control box 40 (FIGS. 2 and 4).

It is implanted such that one of its ends 51 is fixed to the annular support 14 through a screw/nut system 29 and the other end 52 is in simple axial bearing at a given pressure in contact with the upstream part 401 of the control box 40.

This annular element 5 with a predetermined flexibility bearing at a given pressure thus forms a shock absorber for at least some of the vibrations of the control box 40 generated during operation of the turbine.

The damping thus provided according to the invention is a means of dissipating energy from vibrations of the box 40 generated during operation of the turbomachine by a combination of friction at the axial bearing at the other end 52 and braking of the control box 40 due to bending of the annular element between its ends 51, 52 during operation of the turbomachine. In other words, the shock absorbing element 5 improves energy dissipation and dynamic damping of the headers 41, 42 and 43 controlling the radial clearance of the rotating blades of the bladed wheel 18.

The shock absorbing element 5 thus provided avoids mechanical vibration loads from the control box 40 without needing to change the way in which it is attached to the external casing (FIG. 4).

In the embodiment illustrated, each angular sector forming the shock absorbing element 5 is a metal section obtained by forming a plate.

Figure 3:
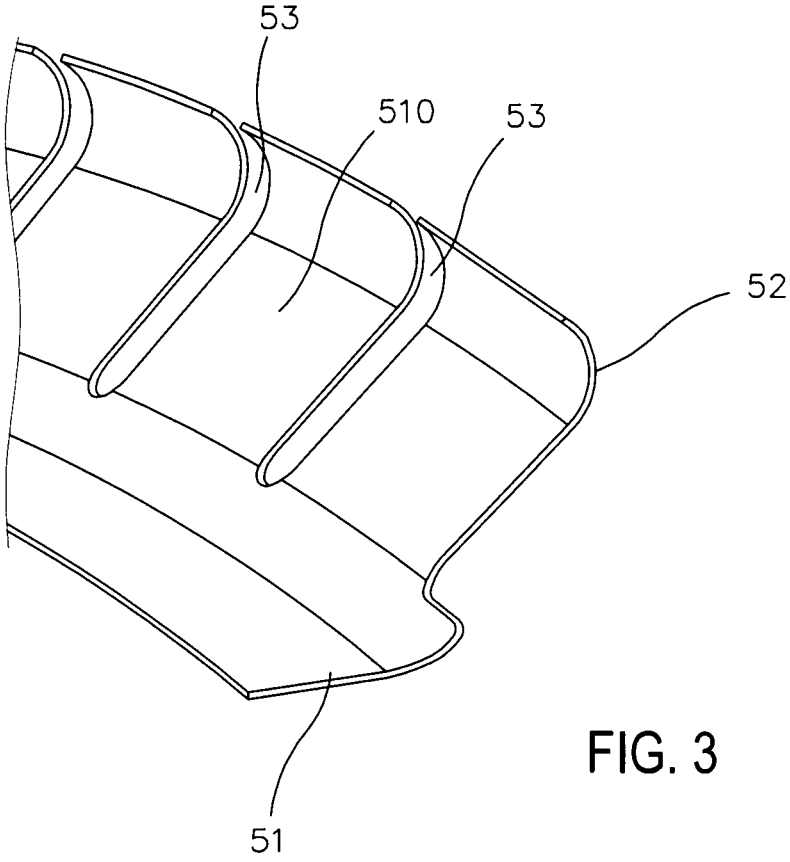
FIG. 3 is a detailed perspective view of a shock absorbing element according to the invention.

As shown in FIG. 3, the geometric shape of the shock absorbing element 5 is composed of a continuous crown at the one end 51 fixed to the annular support and prolonged by a plurality of identical uniformly spaced blades 510 inclined relative to the crown at the one end 51, the curved other end 52 of which forms the pressure bearing with the upstream part 401 of the box. These blades 510 that create the pressure bearing on the upstream part of the box may for example be made from a continuous metal section by "saw cut" type machining diagrammatically represented by the space 53 between two consecutive blades 510. Depending on needs, particularly as a function of the given bearing pressure to be obtained on the box, the number of blades 510 around the entire circumference can be varied by modifying the width of the saw cut made. The number of blades in the shock absorbing element 5 is equal to a multiple of eighteen. For example, a number of blades equal to seventy-two would be desirable. Thirty-six or a hundred and forty-four blades could also be used. The control box 40 and the shock absorbing element 5 are preferably made from the same material that could be a Hastelloy® X type alloy.

It is preferable to insert an anti-wear material in the bearing zone at the other end 52 between the shock absorbing element 5 and the upstream part 401 of the box 40, to prevent premature wear of the control box 40 or the shock absorbing element 5 in mutual friction, and to improve energy dissipation by friction. A Tribaloy® 800 or Tribaloy® 800 type alloy with CoCrAlYSi could be used. The inserted material could advantageously be a layer of anti-wear material deposited on the upstream part 401 of the box 40 in the bearing zone at the other end 52 with the shock absorbing element 5. Making a rough deposit in this manner changes the coefficient of friction and improves energy dissipation.

The shock absorbing element 5 is composed of at least two angular sectors fixed end to end and making up the complete annular shape of the shock absorber. A minimum of two angular sectors satisfies assembly and differential expansion constraints encountered at the attachment area at the one end 51 with the annular support 24 of the high pressure turbine. The number of angular sectors can be increased at will. For example, there may be two, six or eighteen angular sectors fixed end to end and making up the complete annular shape of the shock absorber. Eighteen is a particularly advantageous number of identical angular sectors, because it enables each of them to be attached to the annular support through screws/nuts 29 that arc also used to attach axial stop parts of the spacers. These parts are usually called stop plates.

Thus, according to the invention, the number of angular sectors and the number of blades must be a multiple of the number of attachment screws so that sectors can be identical.

Thus, any means of making the angular sectors by which they can be attached by existing screw/nut systems 29 to fix the axial stop parts is advantageous because the invention does not require any additional means of fixing the shock absorbing element.

The invention as described above is advantageous because it solves the problem of harmful mechanical loads applied to the control box during operation of the turbomachine on which they are fitted due to a shock absorbing element that is:

- easy to make (easily assembled metal section 5),
- adaptable to an existing high pressure turbine without changing the environment (the section is fixed in an existing structural cavity between the external casing 22 and the annular support using screws/nuts that were already provided to fix other parts; no change to the method of fixing the control box).

The invention claimed is:

1. A high pressure turbine of a turbomachine comprising:

an external casing;

at least one distributor formed from an annular row of fixed guide vanes;

a bladed wheel installed free to rotate on a downstream side of the distributor;

an assembly forming a ring placed around rotating blades of the bladed wheel;

a device to control radial clearance between tips of the rotating blades and the ring comprising a control box supporting drilled annular headers and fixed to the external casing at a location of at least two points at a distance from each other;

an annular support including a support device which supports the ring at an inner periphery of the annular support, a wall extending in an upstream direction from the support device, and a radially extending flange connected to the wall for attaching the annular support to the external casing; and a shock absorbing annular element with a predetermined flexibility fixed to the annular support and supported by a simple axial bearing with a given pressure on an upstream side of the control box so as to absorb shock for at least some of vibrations of the box generated during operation of the turbomachine, wherein a first end of the shock absorbing annular element presents a continuous crown which is fixed to the wall of the annular support, a plurality of circumferentially spaced blades extend from the crown and are inclined relative to the crown, and each free end of the blade has a curve which bends radially outwardly and upstream so as to present a convex portion which axially bears against the upstream side of the control box.

2. The high pressure turbine according to claim 1, wherein the shock absorbing annular element includes a metal section made by machining or forming a metal plate.

3. The high pressure turbine according to claim 1, wherein a number of blades in the shock absorbing annular element is equal to a multiple of eighteen.

4. The high pressure turbine according to claim 1, wherein the control box and the shock absorbing annular element are made from a same material.

5. The high pressure turbine according to claim 1, wherein the shock absorbing annular element is fixed to the annular support through screws that also attach axial spacer stops.

6. A turbomachine comprising a high pressure turbine according to claim 1.

7. The high pressure turbine according to claim 1, wherein an anti-wear material is inserted in the bearing area between the shock absorbing annular element and the upstream side of the box so reduce wear of the shock absorbing annular element or the box due to friction.

8. The high pressure turbine according to claim 7, wherein a layer of anti-wear material is deposited on the upstream side of the box in the bearing area with the shock absorbing annular element.

9. The high pressure turbine according to claim 1, wherein the shock absorbing annular element includes at least two angular sectors fixed end to end and forming a complete annular shape of the shock absorbing annular element.

10. The high pressure turbine according to claim 9, wherein the shock absorbing annular element includes, two, six, or eighteen angular sectors fixed end to end and forming a complete annular shape of the shock absorbing annular element.

* * * * *

UNITED STATES PATENT AND TRADEMARK OFFICE

CERTIFICATE OF CORRECTION

PATENT NO. : 8,662,828 B2
APPLICATION NO. : 12/994969
DATED : March 4, 2014
INVENTOR(S) : Gendraud et al.

It is certified that error appears in the above-identified patent and that said Letters Patent is hereby corrected as shown below:

In the Claims

Column 7, line 12, Claim 7, change “box so reduce” to --box so as to reduce--.

Signed and Sealed this
Seventeenth Day of June, 2014

Michelle K. Lee

Michelle K. Lee
*Deputy Director of the United States Patent and Trademark Office*